United States Patent [19]

Briscoe

[11] 4,394,883

[45] Jul. 26, 1983

[54] WELL JAR

[75] Inventor: Edward L. Briscoe, Sheridan, Tex.

[73] Assignee: Dailey Oil Tools, Inc., Houston, Tex.

[21] Appl. No.: 203,527

[22] Filed: Nov. 3, 1980

[51] Int. Cl.[3] ..... E21B 31/107

[52] U.S. Cl. ..... 175/304; 175/321; 29/402.12

[58] Field of Search ..... 175/298, 299, 302, 320, 175/107, 321; 308/4 R, 4 A, 177, 239; 64/27 NM; 29/402.12, 402.15; 76/101 E

[56] References Cited

U.S. PATENT DOCUMENTS

| | | | |
|---|---|---|---|
| 2,023,266 | 12/1935 | Davis | 308/4 A |
| 2,613,917 | 10/1952 | Postlewaite | 175/299 |
| 2,740,651 | 4/1956 | Ortloff | 175/321 |
| 2,754,160 | 7/1956 | Owen | 308/4 A |
| 2,847,260 | 8/1958 | Dillon | 308/4 A |
| 2,991,837 | 7/1961 | Postlewaite | 175/107 |
| 3,080,926 | 3/1963 | Remp, Jr. | 308/4 A |
| 3,208,541 | 9/1965 | Lawrence | 175/299 |
| 3,233,690 | 2/1966 | Lawrence | 175/302 |
| 3,323,326 | 6/1967 | Vertson | 64/27 NM |
| 4,051,696 | 10/1977 | Mason et al. | 65/27 NM |

*Primary Examiner*—William F. Pate, III

*Attorney, Agent, or Firm*—Gunn, Lee & Jackson

[57] ABSTRACT

A well jar having an elongated body with an axial passageway and threaded connections for assembly into a string of well pipe. The body has a tubular mandrel slideably mounted within a tubular barrel with the annulus therebetween exposed to well fluid. Fluid seals in the annulus provide an isolated chamber containing a latch whereby the mandrel and barrel are selectively released for delivering an impact to the wellpipe. The improvement to the jar comprises a plurality of elongated, resilient vibration snubbers integrally carried by the mandrel and aligned longitudinally in the annulus between the mandrel and the barrel. The snubbers slideably engage the barrel throughout its telescopic movement along the mandrel. The snubbers are circumferentially spaced apart about the mandrel with the intervening spaces forming flow channels in the annulus to accommodate well fluid flows when the jar is mounted in the string of well pipe being rotated in the well bore.

In another embodiment, as a subcombination, an elongated, resilient vibration snubber is designed for mounting in a flat bottom groove in a cylindrical metal surface on a well jar. The snubber has a rectangular body of resilient synthetic rubber integrally bonded to a thin metal base. The base and body are provided with one or more transverse apertures to accommodate threaded fasteners. The body has a curved surface on the side opposite to its mounting on the base. Preferably, the snubber is formed of a synthetic rubber with a hardness of about 80 durometer shore-A.

20 Claims, 7 Drawing Figures

WELL JAR

BACKGROUND OF THE INVENTION

1. Field of the Invention

This invention relates to the drilling of well bores into the earth, and more particularly, it relates to a well tool or jar interconnected into the string of well pipe for selectively delivering impacts thereto.

2. Description of Prior Art

Rotary drilling for making a well bore into the earth for the production of oil and gas has been practiced since the early 1900's, and many advantages of such drilling procedure have been appreciated. For this purpose, a well drill string is used and it usually includes a drill bit, drill collars and bore stabilizers, and a plurality of lengths of drill pipe secured to a kelly at the derrick which is situated on the earth's surface above the well bore. The kelly is a non-round, elongated piece of high strength steel that passes through a drive table on a derrick floor and connects to the top of the well drill string. The drive table rotates the drill string through the kelly and by this means, the drilling of the well bore is accomplished. A longitudinal passageway axially through the drill string, provides for the circulation of drilling fluid, commonly termed "mud." The mud passes downwardly in the well drill string, through the drill bit and then upwardly in the surrounding annulus for removing the drill cuttings from the well bore to the earth's surface. For example, a well bore of about 8 inches will require the use of an $8\frac{5}{8}$ inch drill bit, several 8 inch collars and stabilizers which are connected to the kelly through a suitable drill pipe, which may be for example $4\frac{1}{2}$ inches in diameter. In a medium depth well of 15,000 feet, the weight of the drill string, while partially supported by the drilling fluid, is in the neighborhood of about 200,000 pounds. The drilling fluid passes through the well drill string at pressures which can reach 2,500 psi but usually are in a range of about 1,500 during the drilling of a well bore not suffering from any serious problems of penetrating difficult-to-drill formations. The drive table must exert large levels of torque to rotate the well drilling string at the usual rates which may be between 35 to 60 RPM. Although the components of the well drill string appear to be massive and of great strength when viewed at the earth's surface, the drill string in such a moderately deep well, is in reality a highly flexible and relatively easy to damage drilling tool. For example, the drive table may be connected to a power source which can be of a magnitude of 3,000 horsepower. This primeover can apply at the drive table torque levels above 75,000 foot/pounds to rotate the drill string.

Under these conditions, the drill string in even a slightly curved well bore is severely laterally flexed at each revolution while the drilling of the well bore is undertaken. In frequent instances, this repeated flexing can cause injury to even a steel drill pipe.

For example, the bit may deviate from a desired vertical axis, and bore what might be termed a "crooked" hole. In such instances, the large diameter collars and other adjacent drill string components can become lodged in such dog-leg type well bores. If excessive torque is applied to the drill string under these lateral flexing conditions, the pin and box joints interconnecting the drill string or even the drill pipe itself can be torn in two parts. Thus, excessive torque to release the well drill string when it becomes "stuck" in a well bore are to be avoided.

It is common practice in the drilling of well bores to employ a specialized tool in the drill string at its lower end but above tools such as drill collars, reamers, stabilizers, etc., which have a greater diameter than that of the drill pipe. This tool is known in the oil patch as a drilling jar. The jar is a tool which can be placed in a latched condition and then either tension or weight loading applied to the drill pipe. The jar is selectively released and its components telescoped over a fixed dimension, which may be 8 inches, until hammer and anvil parts on the tool engage to deliver an exceedingly large impact or "jar" to the drill string. This type of hammering action, either upwardly or downwardly, will usually release the stuck portions of the well drill string from the well bore.

One jar that has met with universal, world wide acceptance and has been producing good results for many years is availabe commercially under the name "LI Rotary Drilling Jar." The structure and operation of this jar is clearly described in U.S. Pat. Nos. 3,208,541 and 3,233,690, both patents being issued to Mr. Richard R. Lawrence. This drilling jar, of the mechanical type, is capable of delivering adjustably impacts upon the drill string, selectively applied either upwardly or downwardly. These impacts can have maximum values in a $4\frac{1}{8}$ inch drill string of about 250,000 foot/pounds and in a $7\frac{3}{4}$ inch drill string about 770,805 foot/pounds. This rotary drilling jar is capable of repeatedly applying impacts to the well drill string for extended periods of time, as for example, several days in duration. The drilling jar is usually employed in every drill string as an insurance measure to prevent expensive, time consuming and difficult fishing operations to remove stuck portions of a drill string within a well bore.

The rotary drilling jar, of the type described above, must operate in a drilling fluid which contains sand, small particles of formation debris, and sometimes even pieces of metal which are torn from the drill string during the production of the well bore. Conventional rotary drilling jars all employ two telescoping parts which can move together or apart from one another in delivering upward or downward impacts, respectively. The latching mechanism in the jar is usually contained within a sealed and oil-filled chamber. As a result, fluid seals insure a fluid tight sliding interconnecting between the two telescoping parts. Obviously, one end of the annulus between the telescoping parts is exposed to the fluids within the well bore that surround the drilling jar. The well drill string including the jar suffers severe lateral flexing during the drilling of the well bore. Flexing of the jar produces compound longitudinal and axial forces on the fluid seals that can cause them to leak well fluid into the oil-filled latching chamber.

It will be apparent also that the impact delivered by the hammer and anvil surfaces of the jar produce a very substantial vibration effect. This vibration effect can cause injury to the fluid seals and permit the entry of undesired well fluid into the oil filled chamber carring the cocking and releasing mechanism of the rotary drilling jar. In the LI Drilling Jar and as shown in U.S. Pat. No. 3,233,690, one or more annular resilient rings are carried on the external telescoping part or barrel. These rings are adjacent the open annulus end and function as a snubbing mechanism for reducing lateral flexing and vibrations between the telescoping members of the jar and as a result, these rings protect the fluid seals isolating the chamber containing the latching mechanism. For example, in the mentioned patent, the barrel 14 of the jar carries internally enlarged grooves 52 in which annular resilient elements 54 formed of rubber, neoprene or the like are disposed. The inner peripheries of these rings engage the mandrel 22 of the jar to resist lateral movement of the mandrel or barrel so as to protect the fluid seals adjacent to these rings. Additionally, it will be apparent that the annulus between the fluid seals or packing 34 and the annular rings 52 is segregated from the well bore. As a result, telescoping of the barrel and mandrel of the drilling jar greatly changes the liquid volume of this annulus. In order to prevent changes of volume in the annulus which would destroy the seals or the annular rings, openings 58 are provided so that there is fluid communication between the annulus and the surrounding well bore.

In most well drilling operations, the drilling fluid is a drilling mud which has thixotropic properties. These properties allow the drilling mud to be moved by a pump freely through the well bore. However, removal of the pumping force allows the mud to reach a quiessant or resting stage wherein its properties produce a gel or non-newtonian fluid state. Thus, it will be apparent that the segregated annulus between the packing and rings within the mentioned drilling jar is filled with a drilling fluid which is not exposed to circulating flow conditions. Thus, the drilling mud within the annulus of the drilling jar is in a gel stage. The telescoping of the barrel and mandrel of the drilling jar during impact delivery occurs relatively suddenly. However, there is a finite time required for the drilling mud to go from the gel state to its newtonian fluid state and flow between the annulus and the well bore. Thus, a severe piston effect can occur under certain jarring conditions when the drilling mud cannot flow through the mentioned openings 58 with sufficient rapidity to compensate for the fast changing volume of the annulus between the seals and packing. Therefore, the drilling mud by its incomprehensible volume can injure either the fluid seals or the annular rings for snubbing lateral movement or vibration between the barrel and mandrel of the drilling jar. This problem of fast varying annulus volume is common both to mechanical jars and also to other types of jars, such as employing hydraulic mechanisms for the cocking and releasing functions.

Another problem exists relative to the annular rings, such as the rings 52 of the U.S. Pat. No. 3,233,690, which are employed for dampening the lateral movements or vibrations occurring between the inner and outer members as the jar provides the impact function. At impact, large amounts of energy are applied to these members which produce lateral and longitudinal movements or vibrations, both of harmonic and nonharmonic variations. The annular dampening rings 52 of the jar shown in the mentioned patent have produced a remarkable longevity in protecting the fluid seals in the jar. Unfortunately, at infrequent intervals even these annular dampening rings failed to prevent the fluid seals from suffering distructive effects of these induced vibrations. One explanation for this severe effect is that the vibrations induced into the outer and inner telescoping members of the jar are not limited to transverse displacement but include both longitudinal and circular displacements and all variations of their combination. The vibrations induced between the telescoping members of the jar are especially severe when it is recognized that the inner and outer members of the jar in producing the desired impact forces upon the well drill string, in many cases, also rotate relative to one another. Thus, annular snubbing rings, such as employed in the past, can be placed into a failing mode whenever there is a combination of both axial and circular acting vibrations of great magnitude on the inner and outer members of the jar.

The present invention is a well tool in the nature of a rotary drilling jar which has unique resilient snubbers between the telescoping parts of the jar which are so arranged as to reduce the problem of longitudinal flexing and vibration induced injury either to the snubbers or to the fluid seals associated with these jars. In addition, the new snubbers provide fluid passageways which permit the ready flow of the drilling fluid between the well bore and the annulus between the snubbers and the fluid seals. In addition, the snubbers are of a unique design and can be employed with other types of well tool having telescoping members.

SUMMARY OF THE INVENTION

In accordance with this invention there is provided in a well jar for use in a well bore and having an elongated body with an axial passageway for fluid flows. The body has threaded connections for ready assembly into a string of well pipe. The body is formed of a tubular mandrel slideably mounted within a tubular barrel with an annulus exposed to well fluid between the mandrel and the barrel. Fluid seals are positioned at one end of the annulus forming a chamber isolated from the fluid in the well bore. The mechanism to latch and release the mandrel and the barrel is contained within the chamber. The latching mechanism is selectively released for delivering an impact between hammer and anvil surfaces carried on the mandrel and barrel. In particular, the improvment comprises a plurality of elongated resilient vibration snubbers integrally carried by the mandrel and aligned longitudinally in the annulus between the mandrel and barrel. These snubbers are spaced longitudinally from the fluid seals at a location to slideably engage the barrel throughout its telescoping movement along the mandrel. The snubbers are disposed in circumferential spaced apart relationship about the mandrel with spaces forming fluid channels therebetween in the annulus so as to accomodate well fluid flows when the mandrel and barrel are rotated with the string of well pipe in the well bore.

DESCRIPTION OF THE DRAWINGS

In the drawings, like parts will carry like numerals throughout the several views so as to simplify the description of the jar employing the present invention.

DESCRIPTION OF SPECIFIC EMBODIMENTS

Figure 1A:
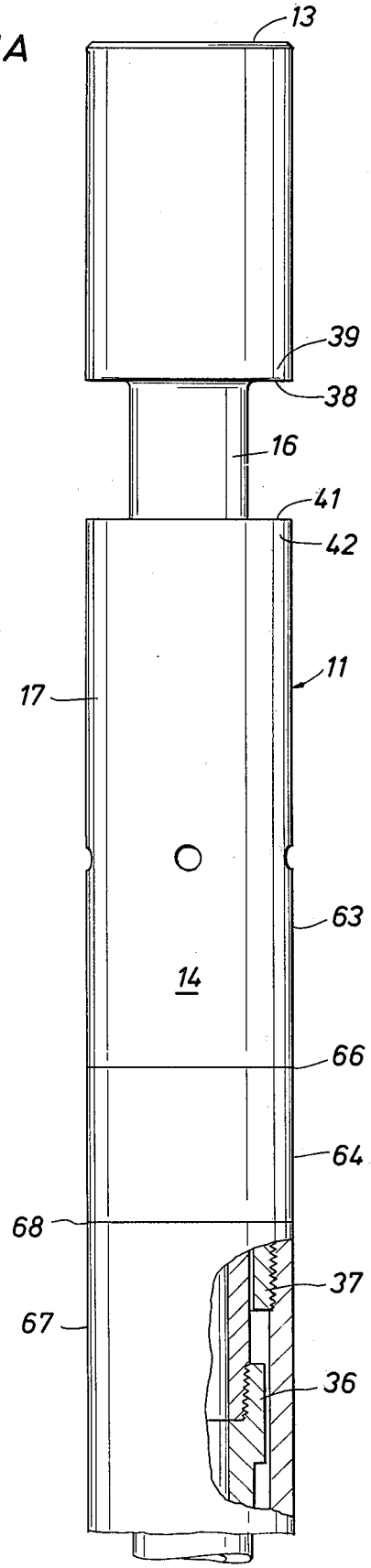
FIGS. 1A and 1B are an elevation of a rotary drilling jar employing the present invention with portions sectioned showing several internal operative components.

Referring to the drawings, there is shown a rotary drilling jar embodying the present invention and this jar is of the type commonly known as a mechanical jar. However, the present invention may be incorporated in other types of jars which have hydraulic or other means for cocking and releasing the jar to provide the desired impact blows to the well drill string. More particularly, the jar illustrated in the drawings is of the type available commercially as the "LI" Rotary Drilling Jar. This jar is described in U.S. Pat. Nos. 3,208,541 and 3,233,691. For descriptive purposes, these patents are incorporated into this description.

Figure 1B:
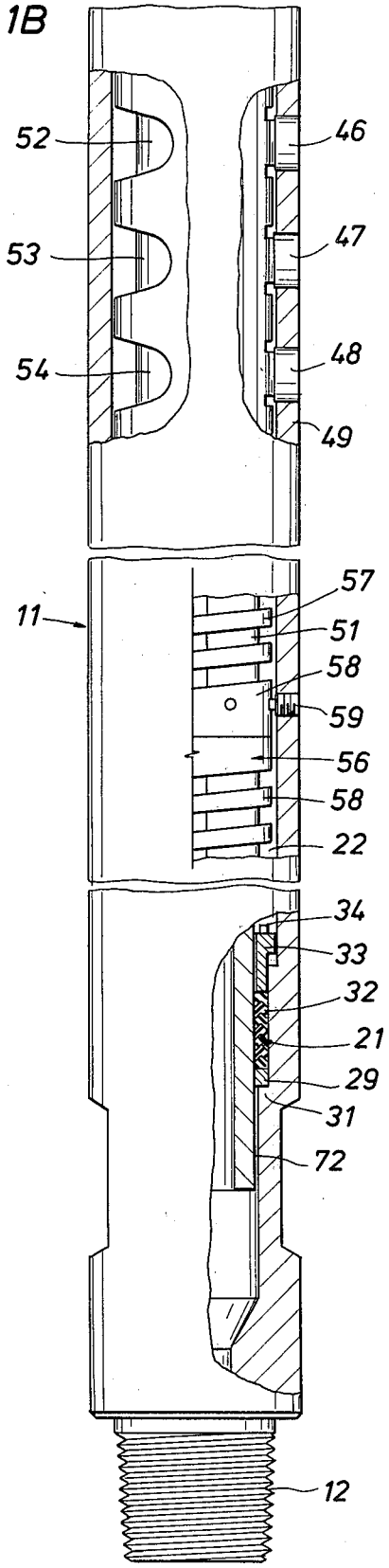
Figure 2:
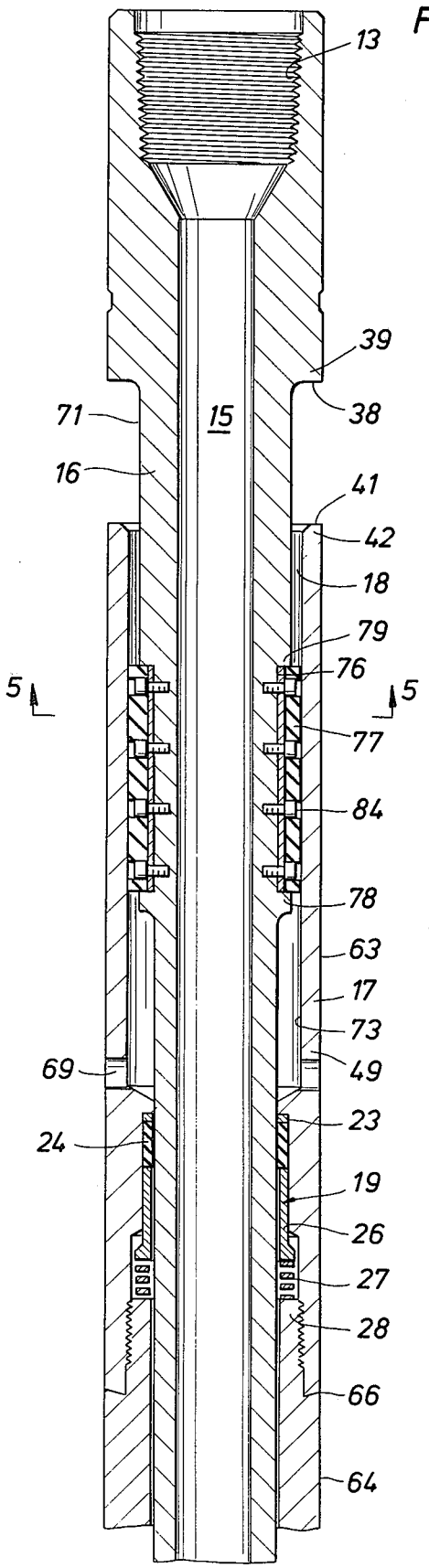
FIG. 2 is a longitudinal section of the upper portion of the jar shown in FIG. 1A with the barrel and mandrel in the cocked position so that the jar can strike an upward or downward impact blow.

More particularly, a mechanical rotary drilling jar 11 is illustrated in FIGS. 1 and 2 and carries a pin 12 at its lower end and a box threaded joint 13 at its upper end for threaded interconnection into a string of well pipe. The jar 11 has an elongated body 14 formed of a tubular mandrel 16 which is adapted to telescope within a tubular barrel 17. An open-ended annulus 18 is formed between the mandrel 16 and the barrel 17. A first fluid seal or packing 19 cooperates with a second fluid seal or packing 21 to provide a chamber 22 that is isolated from well fluid. The chamber 22 usually is filled with clean oil to insure proper functioning of the cocking and releasing mechanism employed with the jar 11.

The packing 19 may be provided by a packing ring 23 within a shouldered recess in the barrel 17 to contain a resilient packing material 24 which is urged into fluid tight sealing relationship by a follower 26. The follower is biased by a coil spring 27 compressed against a shoulder 28 carried on the barrel 17. Similarly, the packing 21 is comprised of a ring 29 that is held against a shoulder 31 on the barrel 17. A resilient packing material 32 is urged into fluid tight sealing relationship against the ring 29 by a follower 33. A spring 34 forces the follower against the packing material. The spring 34 is compressed by a shoulder (not shown) formed within the inner surface of the barrel 17. The packing 19 and 21 cooperate as fluid seals with the telescoping mandrel and barrel to isolate the chamber 22 from the well fluid surrounding the jar 11 when it is in operative position within a well bore. Preferably, the mandrel is of uniform diameter within the packings 19 and 21.

The jar 11 is provided with cocking and releasing mechanisms so that it may be operated both for an upward or a downward impact blow as desired by the operator. For this purpose, the mandrel 16 carries an enlarged portion or hammer 36 that can move into impacting contact by a projecting surface or anvil 37 carried upon the barrel 17. With this arrangement, the jar when locked may be loaded with an upward force by placing the well string into tension. Then, the mandrel is released and the hammer 36 moves into contact with the anvil 37 to deliver the upward impact blow to the well drill string interconnected with the jar 11. In a similar manner, the jar 11 is arranged for delivering a downward blow. For this purpose, the mandrel 16 carries a shoulder 38 which provides a hammer 39 that can impact upon a shoulder 41 forming an anvil 42 on the barrel 11. For this purpose, the jar is cocked and then the well drill string is lowered to provide the desired weight upon the jar 11. The cocking mechanism is released and the hammer 39 moves to strike against the anvil 42 and thereby deliver a downward impact blow to the interconnected well drill string.

Any mechanism may be employed for providing the cocking and releasing mechanism for the jar 11. The preferred form of the cocking the releasing mechanism is an arrangement of drive rollers 46, 47 and 48 which are carried in the side wall 49 of the barrel 17. The drive rollers cooperate with splines 51 carried upon the mandrel 16 so as to transfer a rotary drive motion between the pin and box connections of the jar 11. In addition, the splines 51 are interconnected with jay sockets 52, 53 and 54 carried upon the mandrel 16. The drive rollers interfit within the jay sockets whenever the mandrel 16 is rotated relative to the body 17 when the jar 11 is in the locked or cocked condition. With the drive rollers engaged within the jay sockets, longitudinal force (upward and downward) can be applied between the mandrel 16 and the body 17. Upon a sufficient longitudinal force being applied across these members of the jar 17, the drive rollers will roll away from the jay slots and slide upwardly or downwardly within the spline 51. With the jar in released condition, the telescoping of the mandrel 16 and body 17 occurs until the hammer and anvil surfaces engage to deliver the impact blow to the well drill string. The jar 11 can strike an impact blow upwardly by the hammer 36 striking the anvil 37 or downwardly by the hammer 39 striking the anvil 42. It will be apparent that the release of the drive rollers from the jay slots produces a rotary motion between the telescoping mandrel 16 and barrel. Thus, the forces creating vibration or lateral displacement are compounded through near simultaneous longitudinal and rotational movement of the mandrel relative to the barrel.

The release of the cocked jar is adjustable through the use of a spring assembly 56. For this purpose, torque springs 57 and 58 are pinned at one end to the side wall 49 of the barrel 17. For example, the springs are pinned together by a collar arrangement 58 that is secured by a threaded anchor 59 carried in the sidewall 49. The other end of the springs are carried within a roller slideable in the spline 51. As a result, rotating the mandrel 16 relative to the body 17 adjusts the longitudinal force required to release the drive rollers from the jay sockets. This releasing force may be varied within certain predetermined limits determined by the strength of the springs 56 and 57. Rotating the mandrel 16 in one direction relative to the body causes the springs to be placed in greater tension for holding the drive rollers within the jay sockets and therefore increasing the longitudinal force required to separate these two locking components. Alternatively, rotating the mandrel 16 in the opposite direction relative to the body 17 reduces the longitudinal force to roll the drive rollers from the jay sockets and release the jar for striking an impact blow.

The jar 11 is assembled by providing the body 14 with several cylindrical and threadedly interconnecting parts. For example, the body 14 is comprised of the barrel 17 formed by an upper part 63 threadedly interconnected to an intermediate sleeve 64 by a threaded joint 66. The sleeve 64 is threadedly interconnected to a lower part 67 by a threaded joint 68. The threaded joints 66 and 68 permit the various parts of the body 14 of the jar 11 to be readily assembled and disassembled as desired for production or maintenance purposes.

Figure 3:
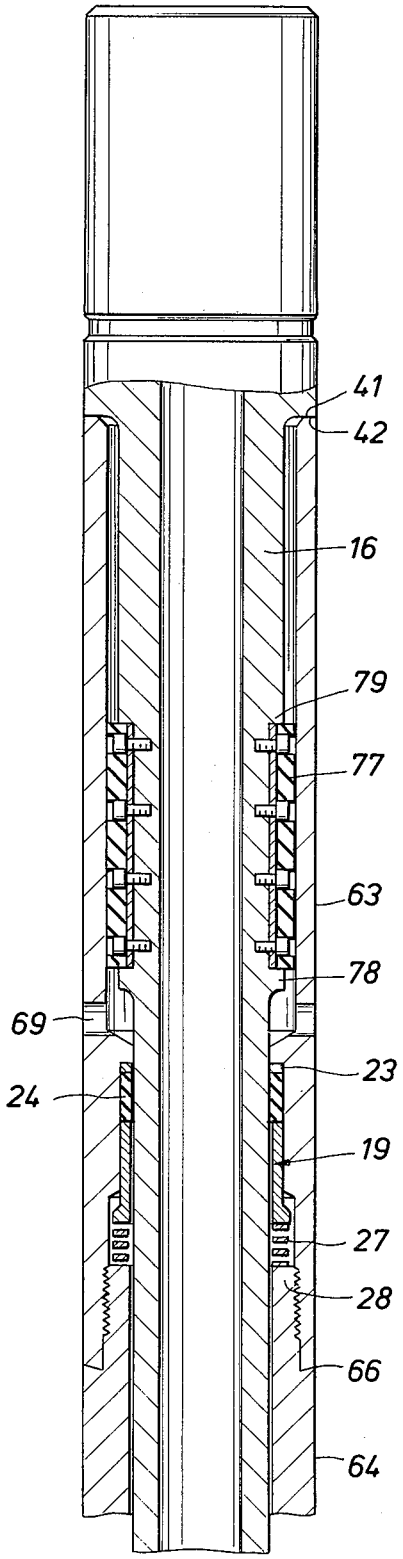
FIG. 3 is a section like FIG. 2 but illustrating the jar after it has delivered a downward impact blow.
Figure 4:
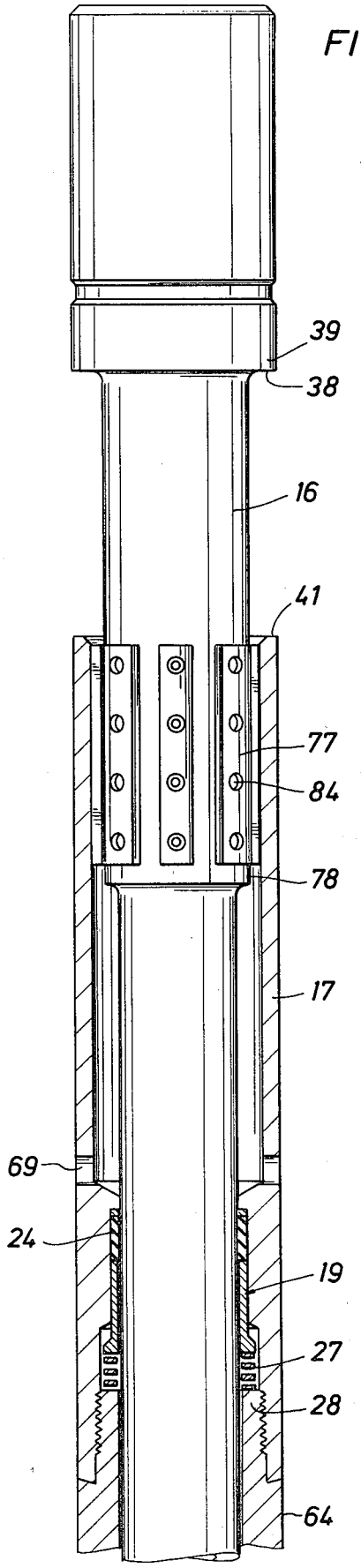
FIG. 4 is a section like FIG. 2 but illustrating the jar after it has delivered an upward impact blow.

The barrel 17 cooperates with the mandrel 16 to produce the annulus 18 that extends from the shoulder 41 to the packing 19. One or more mud vent openings 69 are provided through the side wall 49. The unique design of the snubbers allow mud to circulate freely through the annulus 18 and the well bore. Thus, the mud in the annulus 18 remains in its newtonian state rather than the gel state. The exterior surface 71 of the mandrel 16 is a polished upon a portion of the mandrel which is known as the polished stem. The packing 19 slides easily in fluid tight engagement along this smooth surface 71. The lower portion of the mandrel, as seen by momentary reference to FIG. 1B also has a polished, surface 72. The packing 21 slides easily in fluid tight engagement along the surface 72. Surface 72 is on a portion of the mandrel which is known as the washpipe. In addition, the interior cylindrical surface 73 on the barrel 17 is also a smooth surface. Referring to FIGS. 2, 3 and 4 the snubbers of the present invention will be described in more detail. The snubbers are carried upon the mandrel 16 and slideably engage the surface 73 upon the barrel 17 to resist the lateral movements caused by flexing of the jar when the drill string is rotated in the well bore and also the severe vibrations while the jar 11 is delivering impact blows upon the well drill string. These snubbers also permit the ready flow of well fluid through the annulus 18.

Figure 5:
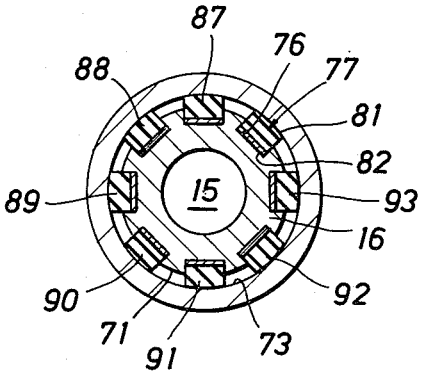
FIG. 5 is a cross section taken along line 5—5 of FIG. 2.

Referring momentarily to FIG. 5, the mandrel 16 in its exterior surface 71 is provided with a plurality of recesses in which are mounted the snubbers of the present invention. For example, the recess 76 is a flat bottom groove aligned with the longitudinal axis of the jar 11. The groove has upright ends to secure the snubbers 77 against longitudinal displacement. More particularly, the groove 76 is formed into the surface 71 of the mandrel 16 for a length sufficient to accommodate the snubber 77 with it being snugly secured at its ends against shoulders 78 and 79. The snubber has a curved surface 81 that engages with an interference fit the surface 73 of the barrel 17 so as to dampen the movements or vibrations between the barrel and the mandrel. The dampening action of the snubber 77 is of a magnitude sufficient to prevent the mandrel 16 from suffering lateral displacement or vibrational distortion sufficient in magnitude to injure the packing 19 in its sealing function, especially during a telescoping of the mandrel 16 and the barrel 17.

Figure 6:
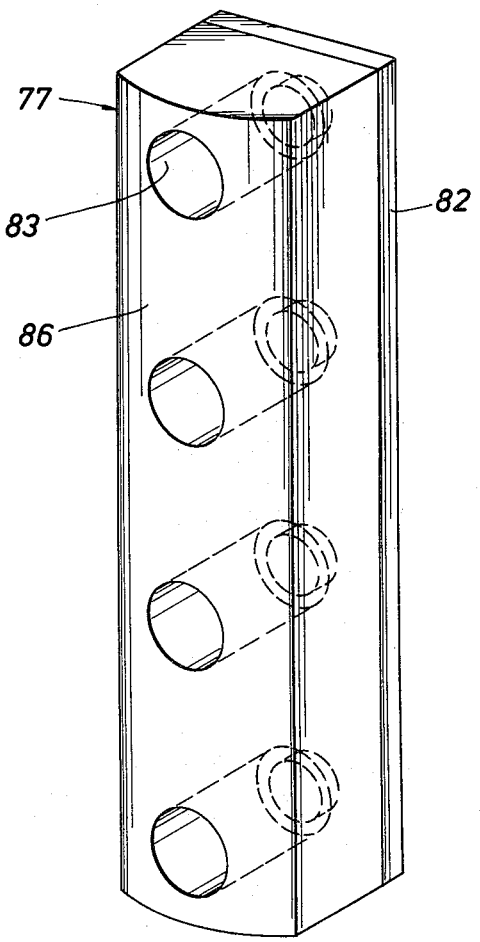
FIG. 6 is a prospective illustrating one preferred embodiment of the snubber employed in the jar illustrated in the preceeding figure.

The snubber 77 is preferably secured within the groove 76 in a releaseable manner so that it can be easily installed or replaced as needed in the life of the jar 11. For this purpose, the snubber 77 is integrally secured to a thin metal mounting plate 82 such as by bonding. For example, thermosetting adhesives can secure the snubber 77 upon the mounting plate 82. The snubber 77 is releaseably secured to the mandrel 16 by any convenient means. Preferably, it is secured by threaded fasteners to the mandrel. For this purpose, as seen in FIG. 6 the snubber 77 is provided with a plurality of transverse holes 83, which extend at a reduced dimension through the plate 82. These holes receive threaded fasteners such as screws 84 which are received in threaded openings into the mandrel 16.

More particularly, the snubbers 77 is formed of a resilient material capable of withstanding the physical and chemical conditions within the service of the jar in a well bore and provide for snubbing the movements and vibration between the mandrel 16 and the barrel 17. For this purpose, it is preferable that the snubber 77 be constructed with a body 86 formed of a resilient material such as a synthetic polymer or rubber material. For example, good results are obtained using a nitrite buna-A synthetic rubber with a hardness of about 80 durometers Shore-A. Other resilient materials capable of performing the desired dampening function can be employed in the snubbers 77, if desired.

Although only one snubber 77 has been described, it will be apparent that a plurality of snubbers are employed and they are spaced circumferentially about the mandrel 16. For example, as shown in FIG. 5, the snubber 77 is equally spaced with the snubbers 87–93 about the circumference of the mandrel 16. Preferably, the spacing between the adjacent snubbers produces a flow passage having substantially the cross sectional area of the snubber within the annulus 18. With this arrangement, a passageway is provided longitudinally between the snubbers for unrestricted flow of well fluid through the annulus 18.

As can be seen best in FIGS. 2–4, the snubbers are positioned on the mandrel 16 spaced from the packing 19 a dimension such that they engage the barrel 17 throughout its telescoping movement relative to the mandrel 16. For example, the jar 11 is shown in FIG. 2 in a cocked position wherein the drive rollers are engaged within the jay slots. FIG. 3 shows the telescoping of the barrel relative to the mandrel wherein a downward impact has been applied to the well drill string by the jar 11. In FIG. 4 the jar 11 is shown wherein the mandrel and barrel are telescoped to deliver an upward impact has been applied to the well drill string. Throughout the functions of the jar 11 shown in FIGS. 2–4, the snubbers 77 have slideable engaged the surface 73 of the barrel 17 throughout its axial movement relative to the mandrel 16. Because of the longitudinal and rotational forces existing between the mandrel and barrel of the jar 17 during rotation of the well drill string and the delivery of the impact blows, the displacement of these members relative to each other is a compound function involving both longitudinal and angular movements. Since the snubbers are elongated and relatively uniformly spaced about the circumference of the mandrel, they can snub movements occurring both longitudinally and angularly between the mandrel and the barrel without impending mud flow through the annulus 18.

Sufficient numbers of snubbers should be employed to achieve the proper dampening of movements between the barrel and mandrel of the jar 11. Usually 4 to 10 equally spaced snubbers are employed wherein the cross sectional area of the snubber in the annulus 18 is substantially equal to the area of the intervening space between adjacent snubbers.

With the described arrangement of the snubbers, the jar 11 can function for extended periods of time without suffering damage from the hydraulic piston effect of the mud in the annulus 18 or the injury to the packing 19 especially by lateral movements between the mandrel and barrel.

It is an important feature of this invention that the snubbers 77 be readily installed and removed from the mandrel 16 by simply releasing the parts of the jar through the threaded joints 66 and 68. Upon replacement of the snubbers, the jar is readily reassembled for continued service in the well bore.

From the foregoing, it will be apparent that there has been provided an improved rotary drilling jar for extended longevity in a well drill string being rotated to produce a well bore into the earth and during its functioning in delivery of impact blows to the drill string. This rotary drilling jar is arranged to incorporate novel resilient snubbers that are long lasting but easily replaced. The snubbers are effective in dampening movements and vibrations resulting from longitudinal and angular forces induced during normal drilling and during the operation of the jar in delivery impact blows upon the drill string. It will be understood that certain changes in the present invention may be made without departing from the spirit of this rotary drilling jar employing resilient snubbers. These changes are contemplated by and within the scope of the appended claims which define the present invention. Additionally, it is intended that the present description is to be taken in a illustrative and not as a limitative definition.

What is claimed is:

1. A rotary well jar subject to severe lateral and longitudinal drill string forces in a fluid-filled wellbore and the well jar having an elongate body with an axial passageway for fluid flows, the body having threaded connections at its ends for assembly into a string of well pipe, the body formed of a tubular barrel with an annulus exposed to well fluid between the mandrel and barrel, fluid seals positioned at one end of the annulus forming an elongate chamber isolated from the fluid in the wellbore and latch means in the chamber to releasably latch the mandrel to the barrel until the latch means are selectively released for delivering an impact between hammer and anvil surfaces on the mandrel and barrel, the rotary well jar comprising;

(a) a plurality of individual resilient vibration snubbers longitudinally, individually mounted circumferentially around said mandrel and at an upper end of said annulus above said latch means and also aligned longitudinally in said annulus between said mandrel and said barrel;

(b) said snubbers spaced longitudinally from said fluid seal at a location to slideably engage with said barrel through out its telescoping movement along said mandrel;

(c) said snubbers disposed in circumferential spaced apart relationship about said mandrel with spaces forming flow channels therebetween in said annulus to accomodate well fluid flows when said mandrel and said barrel are rotated with the string of well pipe in the well bore;

(d) said snubbers having a curved exposed surface for engaging the inner surface of said barrel to dampen vibrational movements between said mandrel and said barrel during their telescoping movements for preventing injury to said fluid seals; and, (e) said snubbers having a diameter, when not confined, larger than the internal diameter of said annulus to define an interference fit on positioning of said snubbers in said annulus.

2. The well jar of claim 1 wherein said snubbers have a spacing leaving at least 50 percent of the area in said annulus between said snubbers as flow channels.

3. The well jar of claim 1 wherein said snubbers are received within longitudinal grooves formed in said mandrel.

4. The well jar of claim 3 wherein said snubbers are releaseably secured within said grooves.

5. The well jar of claim 1 wherein said snubbers are constructed of a polymeric rubber composition having a hardness of about 80 durometer shore-A.

6. The well jar of claim 3 wherein each said snubber is integrally secured to a thin metal mounting plate that is held within said groove by releaseable securing means.

7. A well jar for use in a fluid-filled well bore and having an elongated body with an axial passageway for fluid flows, the body having threaded connections at its ends for assembly into a string of well pipe rotated in the well bore, the body formed of a tubular mandrel slideably and rotatably mounted within a tubular barrel with an annulus exposed to well fluid between the mandrel and one end of the barrel, fluid seals positioned at the end of the annulus remote from the end of the barrel and forming a chamber insolated from the fluid in the well bore, a vent opening in the barrel providing a fluid communication between the annulus and well fluid surrounding the body, and latching means in the chamber to latch the mandrel to the barrel until the latching means are selectively released for deliver of impacts between hammer and anvil surfaces on the mandrel and barrel, and torque loading means in the chamber to bias the locking means with a predetermine angular force regulating release of the mandrel and barrel to enable the mandrel and barrel to move both axially and angularly relative to one another to delivery the impacts creating longitudinal and rotational vibration effects at the end of the mandrel that act deleteriously upon the fluid seals, the rotary well jar comprising;

(a) a plurality of individual resilient vibration snubbers longitudinally, individually mounted circumferentially around said mandrel above said latch means and aligned longitudinally in said annulus between said mandrel and said barrel;

(b) said snubbers spaced from said fluid seals to slideably engage said barrel throughout its telescoping movement along said mandrel;

(c) said snubbers spaced apart circumferentially to provide flow channels in said annulus;

(d) said snubbers engaging said barrel to dampen the lateral displacements and vibrational distortion between said barrel and mandrel for preventing injury to said fluid seals; and, (e) said snubbers having a diameter, when not confined, larger than the internal diameter of said annulus to define an interference fit on positioning of said snubbers in said annulus.

8. The well jar of claim 7 wherein said snubbers have a spacings there between leaving at least 50 percent of the area in said annulus between said snubbers as flow channels.

9. The well jar of claim 7 wherein said snubbers are received within longitudinal grooves formed in said mandrel.

10. The well jar of claim 9 wherein said snubbers are releaseably secured within said grooves.

11. The well jar of claim 7 wherein said snubbers are constructed of a polymeric rubber composition having a hardness of about 80 durameter shore-A.

12. The well jar of claim 9 wherein each said snubber is integrally secured to a thin metal mounting plate that is held within said groove by releaseable securing means.

13. A method of servicing a rotary well jar having an elongate body with an axial passageway from end to end for fluid flow, the body having threaded connections at its ends for assembly into a string of well pipe, the body formed of a tubular barrel with an annulus exposed to well fluid between the mandrel and barrel, fluid seals positioned at one end of the annulus forming an elongate chamber isolated from the fluid in the wellbore and latch means in the chamber to releasably latch the mandrel to the barrel until the latch means are selectively released for delivering an impact between hammer and anvil surfaces on the mandrel and barrel, and further including:

(a) a plurality of resilient vibration snubbers longitudinally individually mounted circumferentially around said mandrel and at an upper end of said annulus above said latch means and also aligned longitudinally in said annulus between said mandrel and said barrel;

(b) said snubbers spaced longitudinally from said fluid seal at a location to slideably engage with said barrel through out its telescoping movement along said mandrel;

(c) said snubbers disposed in circumferential spaced apart relationship about said mandrel with spaces forming flow channels therebetween in said annulus to accomodate well fluid flows when said mandrel and said barrel are rotated with the string of well pipe in the well bore;

(d) said snubbers having an exposed surface for engaging the inner surface of said barrel to dampen vibrational movements between said mandrel and said barrel during their telescoping movements for preventing injury to said fluid seals, the method comprising the steps of:

(1) exposing said snubbers for access thereto;

(2) removing and replacing selected ones of said snubbers with new snubbers mounted longitudinally individually about the circumference of said mandrel; and (3) placing said mandrel and barrel in an operative position relative to one another.

14. The method of claim 13 including the step of disassembling said barrel and mandrel prior to removing selected ones of said snubbers.

15. The method of claim 13 wherein the step of replacing selected snubbers includes mounting new snubbers having a size creating an interference fit of said new snubbers on placing said mandrel and barrel in an operative position relative to one another.

16. The method of claim 13 wherein all of said snubbers are removed and replaced with new snubbers.

17. The method of claim 13 wherein said snubbers are elongate resilient strips having an exposed outer face, and said outer face bears against a confining surface with contact on the exposed outer face in an interference fit.

18. The method of claim 13 further wherein the step of removing an old snubber and replacing the old snubber with a new snubber includes demounting and mounting resilient material snubbers with a rectangular metal base.

19. The method of claim 13 further wherein said new snubbers include:

(a) a rectangular metal base;

(b) a rectangular body of resilient polymeric rubber material bonded to said base;

(c) said base carrying means for releaseably engaging a groove in a mounting part of the well jar;

(d) said body having an exposed surface; opposite its mounting on said base;

(e) said rubber material having a resiliency sufficient for dampening lateral and vibrational movements between said mandrel and barrel; and, (f) said rubber material being adapted to define an interference fit when mounted for positioning in an annulus in a well jar.

20. The method of claim 19 including the step of mounting said resilient body with fasteners placed in transverse aperatures.

* * * * *